United States Patent [19]

Bachmann

[11] 3,968,902

[45] July 13, 1976

[54] TABLET DISPENSER

[76] Inventor: Mario E. Bachmann, 2 E. Oak St., Chicago, Ill. 60611

[22] Filed: Mar. 17, 1975

[21] Appl. No.: 558,900

[52] U.S. Cl. ..... 221/263; 206/537
[51] Int. Cl.[2] ..... B65D 83/04
[58] Field of Search ..... 221/263, 264, 189, 190; 222/365, 366; 206/535, 536, 537, 540

[56] References Cited

UNITED STATES PATENTS

| | | | |
|---|---|---|---|
| 2,935,180 | 5/1960 | Von Martens | 206/535 |
| 3,159,308 | 12/1964 | Passavanti | 221/190 X |
| 3,243,081 | 3/1966 | Schmank | 221/190 X |
| 3,477,561 | 11/1969 | Espinal | 206/536 |

FOREIGN PATENTS OR APPLICATIONS

| | | | |
|---|---|---|---|
| 229,493 | 1/1963 | Austria | 206/535 |
| 222,813 | 1/1962 | Austria | 206/537 |
| 1,276,914 | 10/1961 | France | 206/540 |
| 385,413 | 3/1965 | Switzerland | 206/535 |

*Primary Examiner*—Stanley H. Tollberg
*Assistant Examiner*—Francis J. Bartuska
*Attorney, Agent, or Firm*—Dressler, Goldsmith, Clement & Gordon, Ltd.

[57] ABSTRACT

This invention relates to a personal automatic tablet dispenser for the pocket or purse adapted to contain medical pills, vitamins, sugar substitutes, or the like and in the form of a container shaped somewhat like a writing pen of the ball point type. The dispenser mechanically discharges its contents one item at a time and includes relatively slidable barrel elements forming a housing for a plurality of stacked tablets or the like with a releasable lock mechanism to secure the barrel elements against relative movement. A chamber for one tablet to be discharged is provided and turning means is formed in the housing to position a tablet for passage into the chamber in position for ultimate discharge. The barrel elements are operated against the pressure of a spring means which returns the elements to normally closed position.

5 Claims, 13 Drawing Figures

FIG. 7
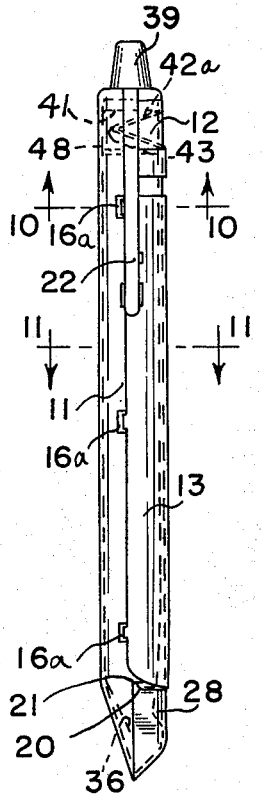
FIG. 8
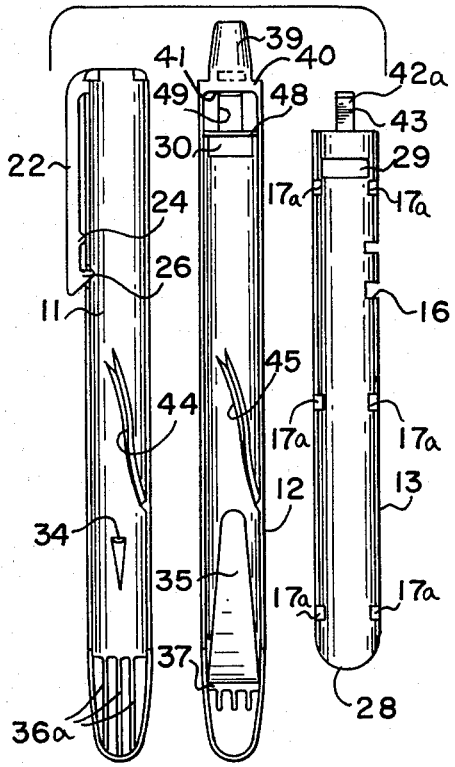
FIG. 12
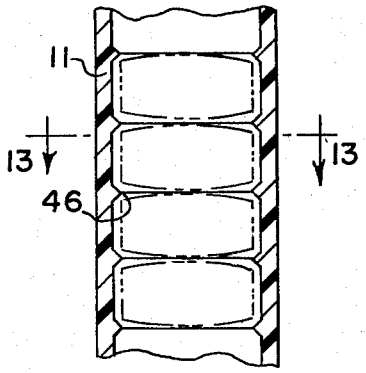
FIG. 13
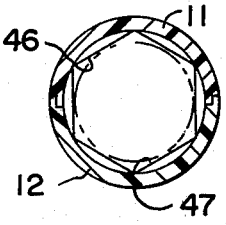
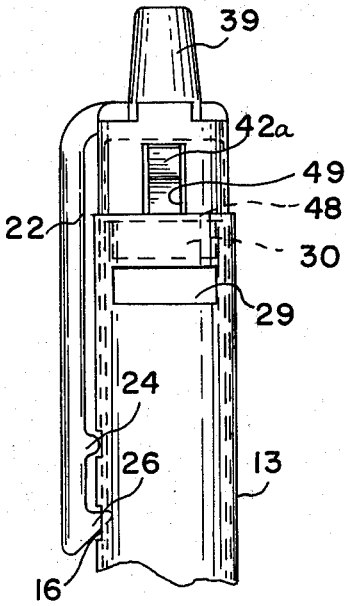
FIG. 9
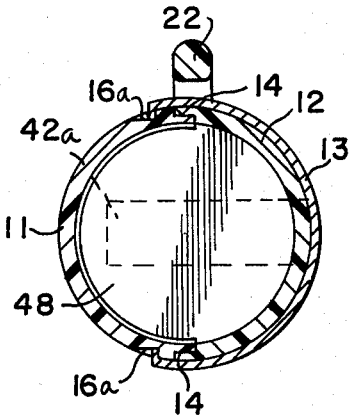
FIG. 10
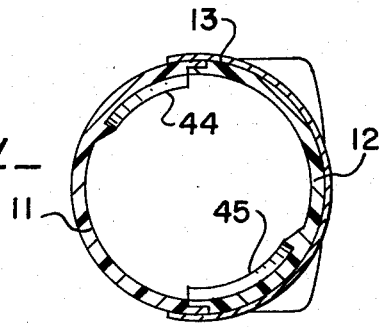
FIG. 11

TABLET DISPENSER

BACKGROUND OF THE INVENTION

Prior art devices are known for containing pills and the like but these are of a type which function merely as holders for the pills and which must be opened for physical removal of the pills and required actual movement of a cover or some such part as by rotation to open or unscrew a cap for removal to gain access to the pills. Where provision may have been included for manually dispensing pills from a container certain prior devices utilized relatively rotatable parts to register a pair of openings whereupon it was necessary to shake a pill out of the container through the opening thus provided. Another device from the prior art resorted to the use of a plunger for pushing pills from a container but this necessitated use of some kind of step-by-step mechanism for pushing but one pill at a time out of the container such as a complicated ratchet device. None of these prior concepts contemplated anything like a simplified economically produced dispenser wherein a number of tablets might be retained in a storage chamber and dispensed one tablet at a time by moving one part of the dispenser relative to another part thereof and especially had no thought of such a dispenser where the relatively movable parts formed the storage chamber for the tablets and which held a supply of tablets captive while one tablet was discharged automatically from the dispenser.

SUMMARY OF THE INVENTION

The invention provides an automatic dispensing tablet container, or holder, for personal use that can be carried in a pocket or a purse for convenience and which can be made for use with any kind of tablet regardless of size and whether of any of various shapes and which might be manufactured as a disposable unit, or it can be made in the form of a refillable container. The dispenser is designed for economical production and can be fabricated substantially from plastics for this purpose and preferably is made from only three parts with two of the related parts comprising plastic elements. The plastic elements form the main body of the tablet container and are relatively slidable with respect one to the other in the operation of dispensing a tablet from one end of the assembly. The third element comprises a shield that overlies one of the first two elements and is connected to the other of these elements by a spring snap action. The shield retains the first two parts in operative relationship while permitting one of such parts to slide relative to the other. The shield also includes a spring which restores the relatively movable parts to normal closed position when a tablet has been dispensed. One of the plastic elements forming the main body includes a device for turning the tablets stacked in the container as they approach the discharge area so that when a tablet moves into the discharge chamber it will do so in proper position to be dispensed through the one end of the dispenser. The other plastic element is provided with a stop to hold the stack of tablets captive in the storage chamber as the one tablet moves into the discharge chamber. A locking device renders the dispenser childproof by locking the relatively movable parts against movement until the lock has been released by a combination of movements involving that of releasing the lock device and then actuating the movable element to dispense the tablet from the discharge chamber and move the next tablet into the discharge chamber.

OBJECTS OF THE INVENTION

The primary purpose of this invention is the provision of a tablet dispenser for personal use which dispenses tablets one at a time automatically and maintains a tablet always ready to be dispensed while retaining a supply of tablets captive in a container from which a discharged tablet is replaced automatically as each tablet is dispensed individually.

The principal object of the invention is to provide an automatic tablet dispenser fabricated from a minimum number of separate elements adapted to function in a simple foolproof manner to dispense tablets individually from a supply of tablets held captive in a container defined by the assembled dispenser elements.

An important object of the invention is the provision of an automatic tablet dispenser formed of three parts including a fixed element and a relatively slidable element forming a tablet storing chamber and an enclosure element maintaining the fixed and sliding elements in operative relationship.

Another object of the invention is the provision of an automatic tablet dispenser formed of three parts comprising a fixed part, a relatively slidable part completing a storage chamber for tablets and an enclosure part maintaining the assembly of the fixed and sliding parts by a clip-on connection to the fixed part.

Another object of the invention is to provide an automatic tablet dispenser having a storage chamber for tablets and a discharge chamber with an automatic turning device in the storage chamber to turn the tablets for entry into the discharge chamber in position subsequently to be dispersed.

Another object of the invention is to provide an automatic tablet dispenser having a tablet storage chamber and a tablet discharge chamber with automatic turning means for tablets entering the discharge chamber and spiral guide means for the tablets in the storage chamber.

A further object of the invention is the provision of an automatic tablet dispenser having a storage chamber for tablets and a discharge chamber with a device to hold a supply of tablets captive in the storage chamber as individual tablets enter the discharge chamber.

A still further object of the invention is to provide an automatic tablet dispenser having relatively slidable elements axially movable and a locking device on one of the elements interengageable with the other element to prevent relative movement thereof.

DESCRIPTION OF THE DRAWINGS

The foregoing and other and more specific objects of the invention are attained by the construction and arrangement of the automatic tablet dispenser device illustrated in the accompanying drawings wherein:

FIG. 7 is a side elevational view of another arrangement of the dispenser representing a further exemplification of the invention;

FIG. 8 is an exploded view of the three elements comprising the dispenser assembly shown in FIG. 7;

FIG. 9 is a view to larger scale illustrating detail features of the dispenser;

FIG. 10 is a cross sectional view through the dispenser taken on the lines 10—10 of FIG. 7;

FIG. 11 also is a cross sectional view through the dispenser taken on the line 11—11 of FIG. 7;

FIG. 12 is a vertical sectional view of a modified form of the dispenser illustrating an arrangement for guiding and maintaining alignment of tablets in the storage chamber of the dispenser; and FIG. 13 is a cross sectional view through the dispenser taken on the line 13—13 of FIG. 12.

DESCRIPTION OF PREFERRED EMBODIMENT

Figure 1:
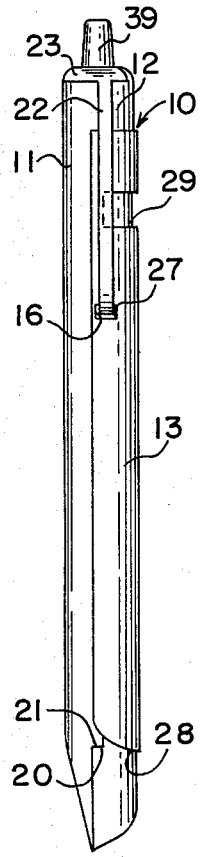
FIG. 1 is a general outside elevational view of an automatic tablet dispensing device constructed in accordance with this invention.
Figure 2:
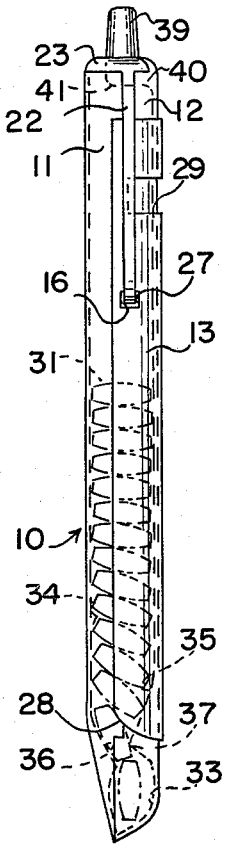
FIG. 2 is an elevational view also of the automatic tablet dispensing device showing the elements thereof in normal closed position.
Figure 3:
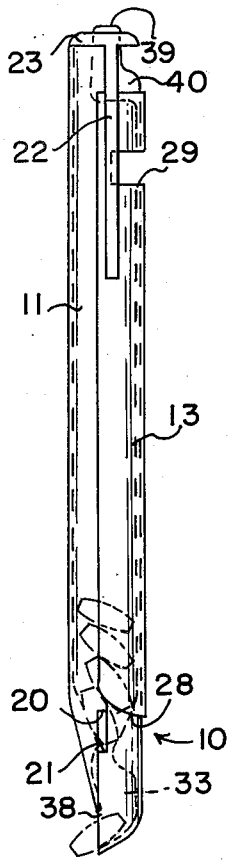
FIG. 3 also is an elevational view of the automatic tablet dispensing device showing the relatively movable parts in the tablet dispensing position.
Figure 4:
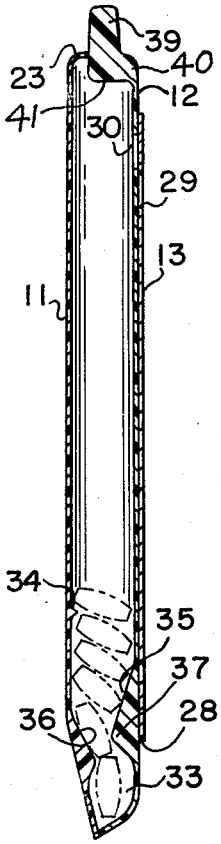
FIG. 4 is a vertical sectional view through the automatic tablet dispensing device showing the tablet storage chamber, the discharge chamber, the tablet turning device and the device for holding the supply of tablets captive in the storage chamber.

In the drawings the general reference 10 represents an automatic tablet dispenser comprised of three parts including a fixed or stationary element 11, a relatively slidable element 12 and an enclosing shield 13 retaining the moveable parts in operative relationship. The relatively moveable parts 11 and 12 are fabricated from a suitable moldable thermoplastic material selected from the group including polyethylene, polypropylene and polyvinyl chloride although other plastic materials may be found suitable also. The enclosing shield member 13, as shown, is disclosed as being fabricated from a suitable metal sheet having the desired resilient spring like characteristics but this element also might be made from a thermoplastic material if desired.

Figure 6:
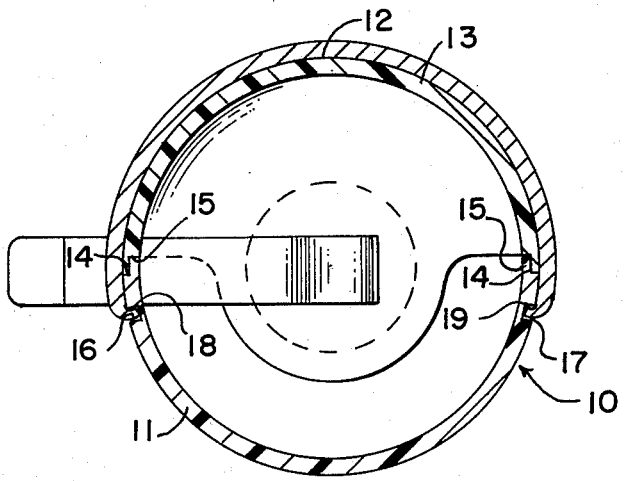
FIG. 6 is a horizontal cross sectional view through the automatic tablet dispenser taken on the line 6—6 of FIG. 5 showing the interengaged sliding relationship of the relatively movable elements and the enclosing shield clipped into place and holding the relatively movable parts in operative relationship.

The tablet dispenser is of generally elongated tubular form and is somewhat in the shape of a fountain pen or more nearly similar in appearance to a ball point pen. The stationary element 11 comprises a semicylindrical section, as best shown in FIG. 6, of elongated configuration extending substantially full length of the dispenser. The relatively slidable element 12 also is of complementally semicylindrical form, as best shown in FIG. 6, and of similar elongated configuration extending full length of the dispenser 10. The stationary and slidable elements are disposed in edge to edge relationship to form a generally tubular housing or container forming a chamber adapted to store a supply of tablets. The opposing elements 11 and 12 are maintained in edge to edge alignment by complemental grooves 14 and 15 forming shoulders on the respectively opposing edges so interengaged as to prevent the two elements from disengaging laterally and thus avoids any possibility of the tube forming elements becoming misaligned.

The tube forming elements 11 and 12 are maintained in this relationship by the enclosing shield 13 and for this purpose the stationary section 11 is provided with a pair of oppositely related channel shaped grooves 16 and 17 on the outer face of this element adjacent to the sliding joint between the two elements. The enclosing shield 13, which is of spring like construction, includes flanges or projections 18 and 19 which are adapted to engage in the respective grooves 16 and 17 and thus maintain the assembly of the three parts in operative relationship. The shield 13 is resilient and in assembling the dispenser elements is pressed onto the interfitted parts 11 and 12 until the projections 18 and 19 snap into the channel grooves 16 an 17 and thus form an enclosure for the sliding element 12 in which this element is adapted to move relative to the element 11 during normal operation and which also maintains the normal operative relationship of the three parts.

Figure 5:
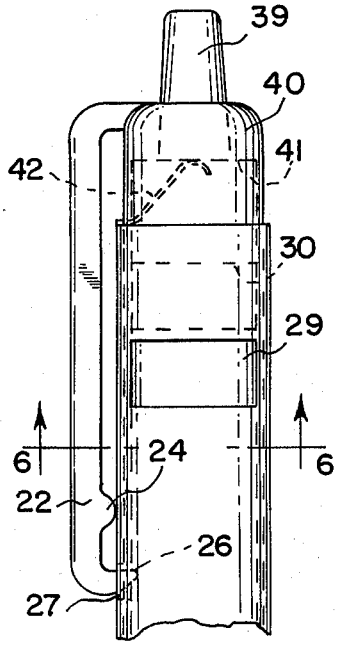
FIG. 5 is a detail view of the upper end of the automatic tablet dispensing device showing the spring device for maintaining the relatively movable elements in normal position and the locking device for securing the parts in normal position.

The semicylindrical element 11 and the relatively slidable element 12 are provided with complementally opposed shoulders 20 an 21 adjacent to the lower or discharge end of the dispenser which serve to limit the relative closing movement of these parts and act as a stop against further sliding movement of the movable element 12 beyond the final closed position of the dispenser. At the upper end of the dispenser the stationary element 11 is provided with a locking device 22 which, is shown, is integral with the top 23 of this element. The locking device extends outwardly from the top 23 and downwardly over the outer surface of the shield 13 and the sliding element 12 as best shown in FIG. 5. The locking device 22 is resilient and is provided with a fulcrum 24 which bears against the outer surface of the shield 13 and about which the locking device is adapted to fulcrum when the portion of the device above the fulcrum is pressed inwardly. The bottom end of the locking device is provided with an inwardly projecting catch 25 which in the locked position engages into an opening 26 in the sliding element 12 and thus prevents relative movement of the part 12 with respect to the stationary element 11. The shield 13 is provided with a notch 27 which enables the latch 25 to pass into the opening 26.

The shield 13 extends substantially full length of the dispenser assembly but stops short of the upper end thereof and similarly stops short of the lower end where it is rounded off as at 28. Adjacent the upper end of the shield it is provided with a window opening 29 which aligns with a similar window opening 30 in the sliding element 12 when that element is moved downwardly in use. Thus, a refill opening is provided for adding tablets to the supply of the tablets 31 stacked in the storage chamber 32 formed by the assembled semicylindrical elements 11 and 12. The tablets 31 are disposed in this generally horizontally disposed stacked relationship in the chamber 32 but are adapted to be turned to a generally vertical position for movement into a discharge chamber 33 at the lower end of the dispenser. The tablets remain horizontally disposed until they come in contact with a projection 34 on the inside surface of the stationary element 11 which tilts the lowermost tablets to cause them gradually to assume a position for entry into the discharge chamber 33 in a vertical position. This assumption of the proper position for entry into the discharge chamber 33 is aided by a complementally sloped guiding surface 35 formed on the inner surface of the opposed sliding member 12. The tablets are guided down this sloping surface in their tilted position until the lowermost tablet of the stack comes into contact with the surface 36 on the inside face of the stationary member 11. At this point the lowermost tablet is in position to assume the vertical position upon entry into the discharge chamber 33.

The sloping surface 35 on the inside face of the element 12 terminates in a bottom stop 37 which functions to hold the stack of tablets in the storage chamber 32 until the dispenser is actuated to discharge a tablet. It will be noted that the discharge chamber 33 is formed by complementally contoured inside surfaces of the stationary and sliding elements 11 and 12 and when the sliding element is actuated downwardly to discharge a tablet an opening 38 is provided through which the tablet in chamber 33 exits. The lowermost tablet 31 resting on the surface 36 is prevented from moving into the chamber 33 by the stop 37 until the sliding element 12 is released and allowed to return to the retracted position whereupon the lowermost tablet enters the chamber 33 to replace the tablet discharged.

The sliding element 12 is actuated by means of a push button 39 located on the top 40 of this element and projecting upwardly through an opening in the top 23 of the stationary element 11. The underside 41 of the top 40 forms a surface that is engaged by a spring 42 that is deflected or compressed when the push button 39 is depressed to actuate the dispenser for discharging a tablet. When the push button is released the spring 42 restores the slidable element 12 to its normal retracted position. The spring 42, as shown, is illustrated as being integral with the shield 13 but a separate spring might be utilized if preferred and disposed to function between the stationary and sliding elements.

In the operation of this dispenser a user would grasp the dispenser in one hand with the index finger pressing the resilient lock device 22 in the area thereof to fulcrum the latch 25 about the fulcrum 24 to release the lock and press the push button 39 with the thumb to actuate the sliding element 12 for the purpose of dispensing a tablet from the discharge chamber 33. When the thumb pressure is released the spring 42 restores the sliding element to its normal retracted position. It is entirely possible that a user might prefer to hold the dispenser in a manner such that the thumb is utilized to press on the lock device and the push button 39 is actuated by the index finger. The choice as to the method of operation is entirely at the discretion of the user since the dispenser will function equally well by either method of operation.

In the assembly of the parts comprising this dispenser the shield 13 might be supported in a fixture somewhat in the form of a cradle with the open side of the semicylindrical section facing upwardly. Then the slidable section 12 would be placed in the shield with the open side of the semicylindrical section also facing upwardly. A supply of tablets would then be placed in the open member 12 and the stationary section 11 would then be placed open side down over the tablets in edge to edge engagement with the section 12 and exerting sufficient downward pressure to engage the grooves 16, 17 and the projections 18, 19 whereupon the assembly is completed. This procedure of course might be reversed and the stationary member 11 first placed in the fixture, loaded with tablets, the slidable member 12 applied over the tablets and the shield 13 then snapped into place to secure the assembly.

The invention is further exemplified by the construction and arrangement illustrated in FIG. 7 wherein it will be seen that the three elements 11, 12 and 13 are of generally similar design and construction to that of the corresponding elements shown in FIGS. 1–6 and accordingly similar characters of reference have been applied to the corresponding parts. However, the guide surface 36 in the fixed element 11 leading to the tablet discharge chamber 33 is formed by a plurality of aligned ribs **36*a* which perform the same guiding and positioning functions for the tablet entering the discharge chamber 33 as that performed by the guide surface 36 in the form shown in FIG. 4.**

The projection 34 on the inside surface of the fixed element 11 performs the same function of turning the tablets to position them for vertical entry into the discharge chamber in the same manner as in the previous version but diametrically oppositely arranged guide ribs 44 and 45 are provided in the tablet storage chamber formed on the inner surface of the respective fixed and slidable elements 11 and 12 respectively and which together form a spirally arranged guideway for the tablets. As shown, this guiding action takes place in the storage chamber ahead of the tablet turning operation inasmuch as the spiral guides 44, 45 are located above the turning device 34. In this way the proper position of the tablets in the storage chamber is maintained at all times for efficient movement of the tablets toward the discharge chamber and in the proper position for that purpose. A top end closure wall 48 is formed in the sliding element 12 and projects into the fixed element 11 to define the topmost limit of the storage chamber for the stacked tablets 31 and separates the storage chamber from the area containing the return spring **42*a*.**

The fixed element 11 is provided with a plurality of spaced apart indentations **16*a* disposed at intervals along the outer surface of this element adjacent to the respectively opposite edges thereof. These indentations 16*a* are engaged by the spring clips 17*a* on the respectively opposite edges of the closure shield 13 and serve to hold the assembled elements in operative relation while permitting the relative sliding movements of the element 12 within the enclosure afforded by the shield 13. In assembling the several parts for operative relationship the same procedure may be used as that utilized to assemble the dispenser of FIGS. 1–6 with the shield 13** finally being snapped into place to maintain the assembly.

An alternate arrangement of the storage chamber forming elements 11 and 12 is illustrated in FIGS. 12 and 13 wherein the inner surfaces of the fixed and sliding elements 11 and 12 are provided with complementally spaced inward projections 46 and 47 which when the elements 11 and 12 are assembled together, provide a hexagonally shaped guide for the stored tablets, as best indicated in FIG. 13. The hexagonally shaped projections are spaced apart in the tablet storage chamber by approximately the thickness of a tablet and function to prevent stacked tablets from becoming sideways in the chamber prematurely. The tablets thus are maintained in proper alignment until the point is reached where the tablets are positively turned by the device 34 for passage into the discharge chamber.

A spring **42*a* in the version represented by FIGS. 7–13 functions similarly to the spring 42 in the FIGS. 1–6 version, to restore the relative positions of the fixed and sliding elements 11 and 12 after actuation by means of the pushbutton 39. Spring 42*a* however is reversely bent as at 43 whereby to provide two relatively angled leaf portions and thus afford greater resiliency and travel to enable full opening of the discharge chamber for the ready exit of a tablet and then return the discharge chamber to closed position with the restoration of the elements 11 and 12.**

The spring 42*a* is integral with the shield 13 and passes through an opening 49 in the sliding element 12 for positioning in the area between the underside 41 of the top wall 40 of the sliding element and the top wall 48 of the element 12.

From the foregoing it will be seen that there has been provided a personal dispenser for tablets, or the like, which dispenses the contents automatically one at a time and automatically maintains a tablet ready to be dispensed and automatically changes the position of tablets approaching the discharge point while holding the supply of tablets stored in the dispenser captive until discharged. The dispenser is of simple three part construction adapted to be assembled with minimum effort and expense and economical of manufacture.

What is claimed is:

1. A tablet dispenser of elongate tubular form comprising a semicylindrical stationary section, a relatively slidable section of semicylindrical section in edge to edge opposed relation complemental to the stationary section, and a shield of semicylindrical section overlying said slidable section and releasably secured to said stationary section by a snap fit engagement therewith, said stationary section and said slidable section form a storage chamber for containing a supply of tablets and a discharge chamber for holding and dispensing said tablets, said slidable section being movable relative to said stationary section to open said discharge chamber to dispense a tablet, a push button for moving the slidable section, spring means to restore said slidable section and close said discharge chamber after the tablet is dispensed, a top end wall on said slidable section projecting into said stationary section separating said storage chamber from said spring means, said stationary section having an integral projection on the inside surface thereof to tilt said tablets and said slidable section has a sloping guide surface on the inner side thereof to guide the tilted tablets toward said discharge chamber terminating in a stop holding the supply of tablets captive in said storage chamber, an integral interior inclined surface on said stationary section cooperating with said stop to retain a lowermost tablet ready to move into said discharge chamber when said slidable section is restored, and opposing stop means on the stationary and slidable sections to limit the movement of said slidable section to its restored position.

2. A tablet dispenser as set forth in claim 1 wherein said shield has lateral projections on the lengthwise edges thereof, and said stationary section has a pair of spaced outwardly open indentations on the surface thereof, said projections being engaged respectively in said indentations.

3. A tablet dispenser as set forth in claim 1 wherein said stationary and slidable sections include spirally arranged guide means on the inner surfaces thereof.

4. A tablet dispenser as set forth in claim 1 wherein guide means on the inner surfaces of the stationary and sliding sections provide a hexagonally shaped guideway when the sections are assembled together.

5. A tablet dispenser as set forth in claim 4 wherein said hexagonally shaped guideway includes a plurality of hexagonally shaped members spaced apart lengthwise of said storage chamber substantially by the thickness of said respective tablets.

* * * * *